US005547345A

United States Patent [19]

North, III et al.

[11] Patent Number: 5,547,345

[45] Date of Patent: Aug. 20, 1996

[54] COUNTER FOR A PLURAL-CHAMBER PNEUMATIC PUMP

[75] Inventors: Thomas G. North, III, Woodstock, Ga.; Thomas Graham, Ocean; Yushan Wang, Howell, both of N.J.

[73] Assignees: Standard Keil Industries, Inc., Allenwood, N.J.; The Coca-Cola Company, Atlanta, Ga.

[21] Appl. No.: 415,292

[22] Filed: Apr. 3, 1995

Related U.S. Application Data

[62] Division of Ser. No. 381,538, Jan. 31, 1995.

[51] Int. Cl.[6] ..... F04B 53/00

[52] U.S. Cl. ..... 417/63; 417/393

[58] Field of Search ..... 417/63, 393, 395, 417/534; 116/272, 273, 281, 285, DIG. 21

[56] References Cited

U.S. PATENT DOCUMENTS

| | | | |
|---|---|---|---|
| 571,751 | 11/1896 | Crocker | 417/393 |
| 2,483,924 | 10/1949 | Moulinier | 417/63 |
| 3,317,083 | 5/1967 | Morrill | 417/63 |
| 4,037,616 | 7/1977 | Pinkerton | 417/393 |
| 4,172,698 | 10/1979 | Hinz et al. | 417/393 |
| 4,468,222 | 8/1984 | Lundquist | 417/395 |
| 4,540,349 | 8/1985 | Du | 417/393 |
| 5,334,003 | 8/1994 | Gardner et al. | 417/393 |

FOREIGN PATENT DOCUMENTS

| | | | |
|---|---|---|---|
| 325990 | 4/1935 | Italy | 417/395 |

*Primary Examiner*—Timothy S. Thorpe
*Assistant Examiner*—Roland G. Andrews, Jr.
*Attorney, Agent, or Firm*—Schweitzer Cornman & Gross

[57] ABSTRACT

A pneumatic pump of the type having a pair of pump chambers each divided by a diaphragm assembly coupled by a main shaft includes a housing having a central valve chamber. An integral counter, mounted in the pump housing, is also coupled to the diaphragm shaft, and provides a count of the number of shaft reciprocations performed.

5 Claims, 9 Drawing Sheets

COUNTER FOR A PLURAL-CHAMBER PNEUMATIC PUMP

This application is a division of application Ser. No. 08/381,538 filed Jan. 31, 1995.

BACKGROUND OF THE INVENTION

The present invention relates to a new and improved pump which is driven by pneumatic pressure and which includes an integral counter assembly.

In the beverage service industry syrups and concentrates utilized for the preparation of soft drinks are normally provided in bulk containers for blending with the soft drink liquid base on a demand basis. The syrups are viscous and, in their undiluted state, somewhat reactive, and thus can interfere with the proper operation of conventional pump mechanisms utilizing a reciprocating piston which slides back and forth in a cylinder. In addition, conventional electrically operated pumps, when overloaded or stalled, can cause failure of the drive motor windings, thus requiring often extensive and expensive repairs as well as creating the possible risk of fire or damage to associated components as a result of excessive heating of motor windings in the stalled state. Pumps using electric motor drives further are also relatively bulky.

Pneumatically-operated pumps, in which one or more diaphragm-type pistons are utilized, are known in the art and are typically of a more compact size than electric pumps having a similar output capacity. In addition, such pneumatically-operated pumps are in practice driven by the same source of compressed gas, namely carbon dioxide, which is utilized to carbonate the liquid base. Such pumps have the further inherent advantage that an electrical supply is not required for their operation.

Conventional pumps of the pneumatic variety are exemplified by the teachings of U.S. Pat. Nos. 4,123,204 to Scholle and 4,540,349 to Du. In the Scholle pump, the driving compressed gas is directed to opposed piston chambers through a complex series of passageways and valves wherein the valve actuating stems contact stop members within the pump apparatus. The Du pump relies upon the longitudinal shift of a valve element by the alternate interaction between opposed internal pipe ends with the respective pistons as they oscillate, Because of the complexity of the demands placed upon the valving apparatus which alternates the pressurization of the piston chambers, and the form and nature of the seals required between the moving parts and their fixed housings, pneumatic pumps are subject to leakage and often unexpected failure. As the valving is located deep inside the pump, the pump must be removed from the apparatus with which it is used and disassembled for repair or replacement purposes, further, the life of the pump is a function of its operating time and thus the number of reciprocations which the pump has performed. It has heretofore been difficult to determine with any precision when the useful life of the pump is expiring, as conventional pumps have provided no means by which actual operation can be monitored.

It is accordingly a purpose of the present invention to provide a pneumatic pump wherein a counter mechanism is incorporated into the pump to provide a direct reading of the number of pump reciprocations.

Another purpose of the present invention is to provide a pump in which the counter mechanism is located substantially within the body of the pump.

Still another purpose of the present invention is to provide a pump in which the counter is mounted within a sidewall of the pump and is exposed to the pressurizing gas.

Still a further purpose of the present invention is to provide a counter assembly of compact form and construction which is capable of being incorporated into a pneumatic pump without significantly increasing the size of the pump.

Yet a further purpose of the present invention is to provide a counter assembly which is directly driven by a reciprocating member of the pump with which it is employed.

BRIEF DESCRIPTION OF THE INVENTION

In accordance with the above and other objects and purposes, a pump of the present invention includes a housing having a pair of opposed pumping chambers each having a flexible diaphragm of known character. As known, the two diaphragms are joined by a common shaft, and divide the chambers in which they are located into a first portion into which the liquid to be pumped is drawn and subsequently expelled, and a second portion which is alternately pressurized by the driving gas and exhausted. The pressurization of the portion of a first chamber is synchronized with the exhaust of the portion of the second chamber, causing the diaphragms and joining shaft to reciprocate in a coordinated manner, whereby the fluid to be pumped is drawn into a first chamber simultaneously with the fluid in a second chamber being expelled. As the shaft and diaphragms continue to reciprocate, a constant flow of pumped liquid is effectuated.

A valve chamber is formed within the housing, the chamber including a chamber portion formed with a pair of opposed side walls each having a port connected to one of the pumping chambers by an internal passageway. A valve body with opposed faces is mounted within the chamber portion for pivoting reciprocation between two positions whereby a gas passageway within the valve body and vented to the atmosphere is alternately connected to one of the ports in the valve chamber portion side walls. A mechanical connection between the valve body and the diaphragm shaft is provided whereby reciprocation of the valve body between the two positions is coordinated with action of the diaphragm shaft. As the shaft reciprocates, it alternatively aligns the valve body with one of the ports, connecting it to one of the second portions of a pumping chamber, venting the portion to the atmosphere. Simultaneously, the second port is exposed to a pressurized gas flow which is introduced into the valve chamber from an exterior source. As the second portion of the first pumping chamber is exhausted, the second portion of the other pumping chamber is provided with pressurized gas. The alternating pressurization and exhaust of the second pumping chamber portions cylinders drives the diaphragms and shaft for pumping action.

The valve chamber preferably extends through a side wall of the pump housing, and is sealed by a removable cover plate which permits direct access to the valve body and thus replacement without the necessity for pump disassembly. The valve chamber may further extend through a second side wall, forming a valve chamber portion in which a counter assembly may be located. The counter, which may be of a mechanical form having a decade gear assembly, is coupled to a reciprocating member of the pump, and provides an indication of the total number of pumping cycles for the pump. The valve chamber portion in which the counter assembly is located is similarly sealed by a cover plate.

BRIEF DESCRIPTION OF THE DRAWINGS

A fuller understanding of the present invention and the features and benefits thereof, will be achieved upon consideration of the following detailed description of a preferred, but nonetheless illustrative embodiment of the present invention when reviewed in association with the annexed drawings, wherein.

DETAILED DESCRIPTION OF AN ILLUSTRATIVE EMBODIMENT

Figure 1:
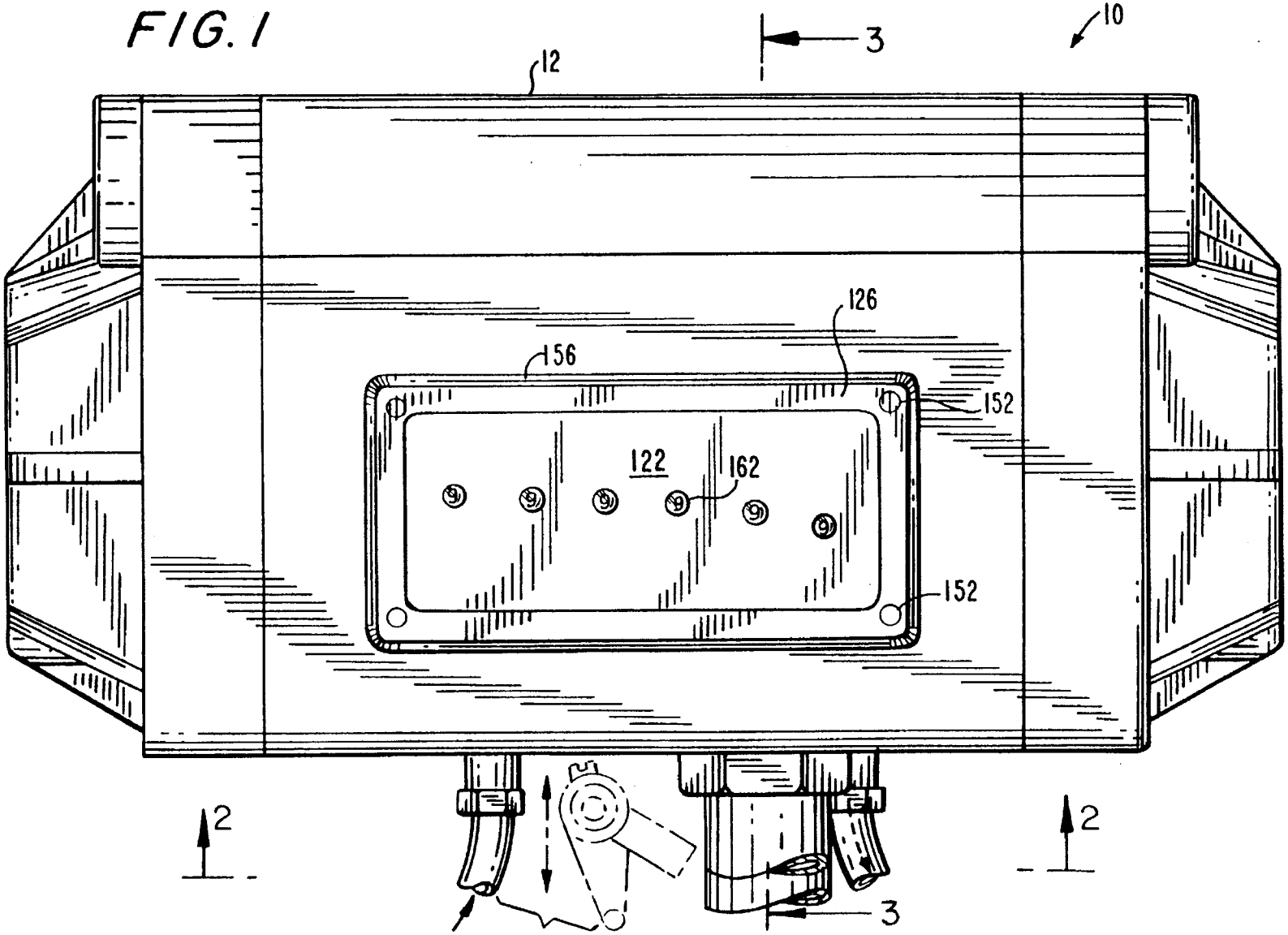
FIG. 1 is a front view of an illustrative embodiment of the invention.
Figure 2:
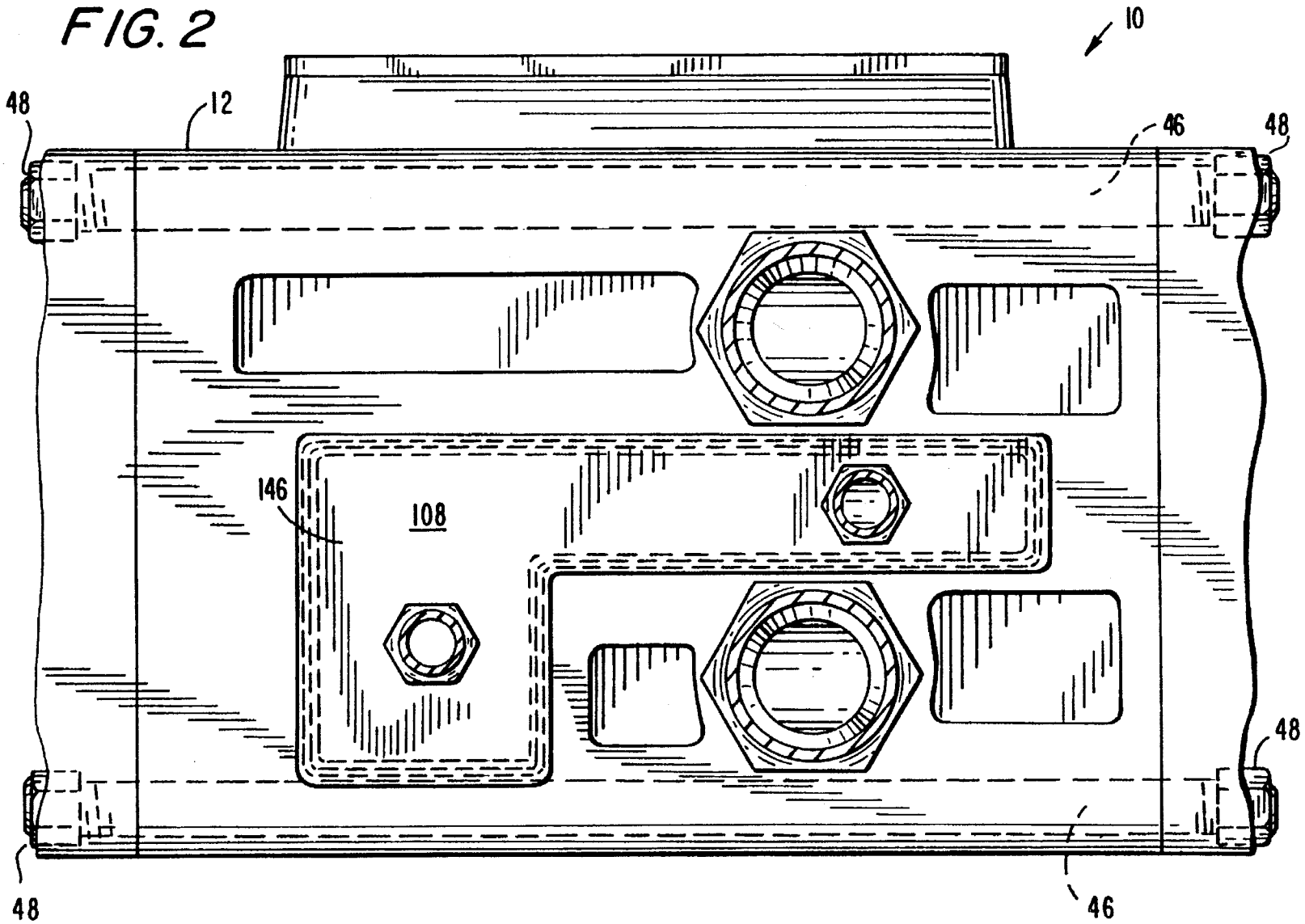
FIG. 2 is a bottom plan view of the central part of the embodiment depicting gas and liquid connections.
Figure 3:
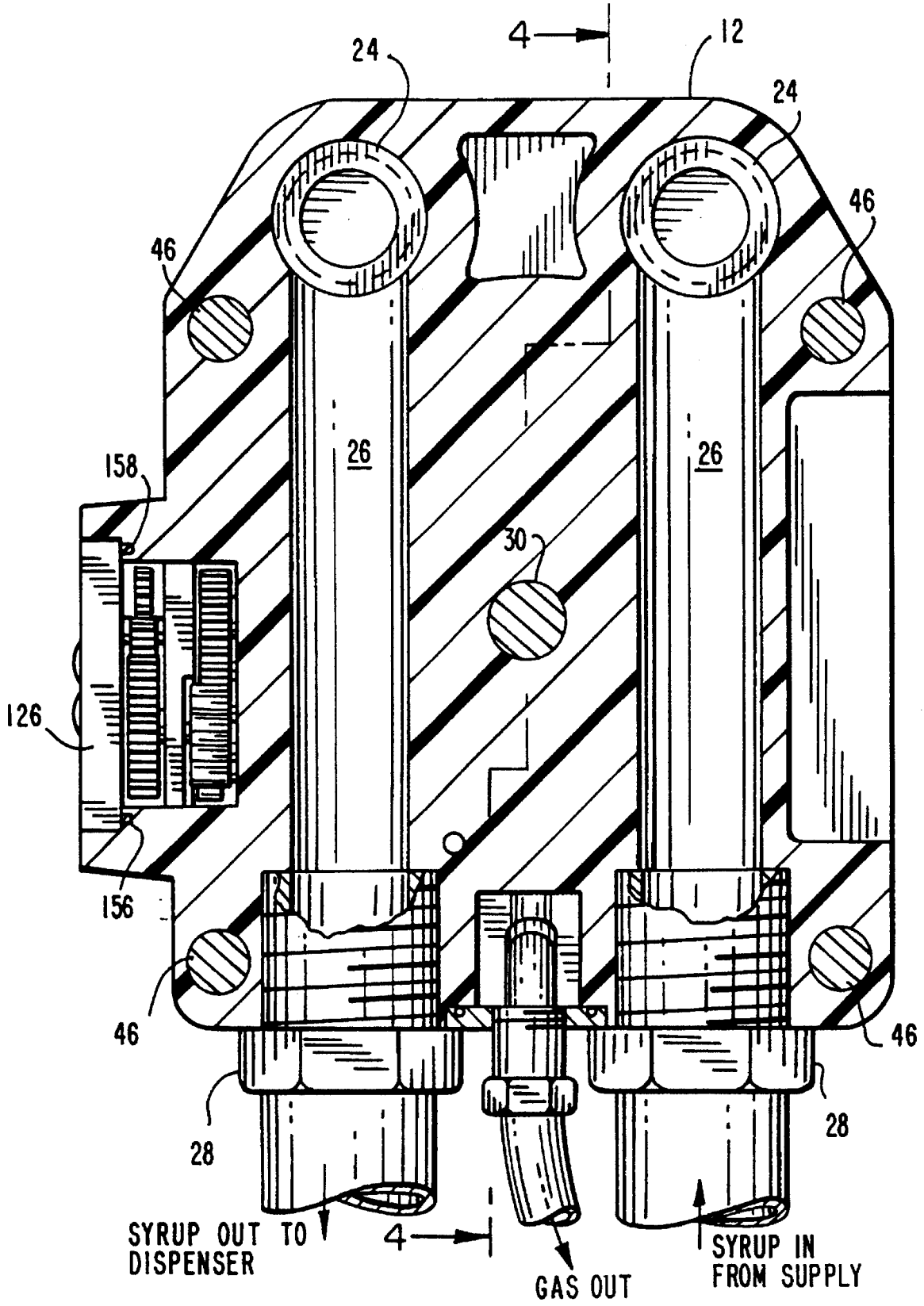
FIG. 3 is a cross-sectional view taken along line 3—3 of FIG. 1.
Figure 4:
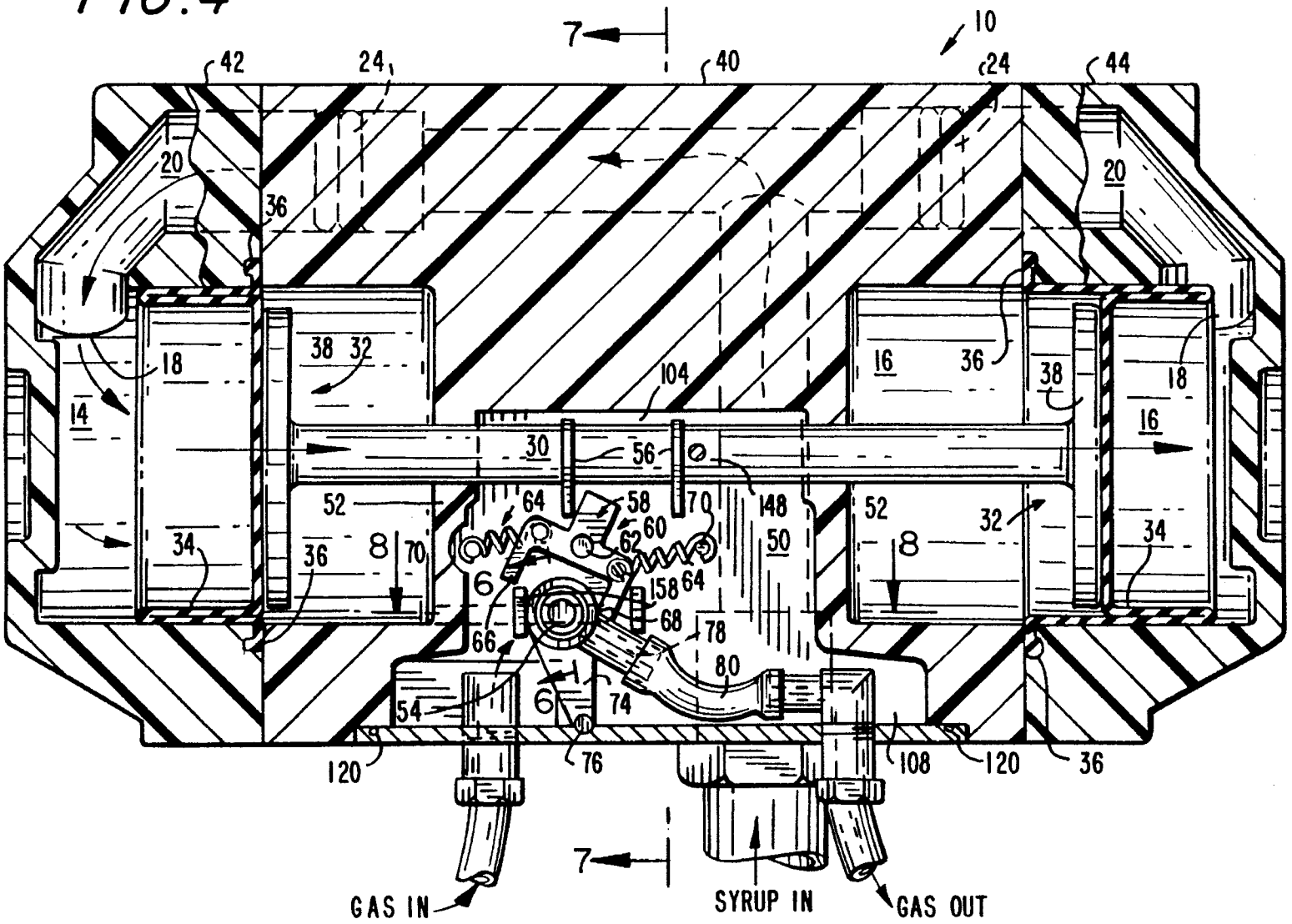
FIG. 4 is a cross-sectional view taken along line 4—4 of FIG. 3, while the diaphragm shaft is moving to the right.

Referring initially to FIGS. 1, 2 and 4, a pump assembly 10 constructed in accordance with the present invention may comprise a housing 12 having an inner construction in which first and second pump chambers 14 and 16 are located at opposite ends of the housing. Each of the pumping chambers is provided with an inlet 18 as shown in FIG. 4 and a corresponding outlet (not shown) for the liquid to be pumped. The inlets and outlets for the two chambers are each joined by an internal connecting passageway, 20 and 22, respectively, each incorporating pairs of one-way valves 24 to prevent the pumped liquid from being returned to the pumping chambers from the exit passageways and from being driven back to the liquid source. The connecting passageways are coupled through main passageways 26 to the connectors 28 mounted to the exterior of the housing to permit appropriate piping to be connected between the pump, the source of the pumped material, and its destination.

Pumping action is obtained by the reciprocation of diaphragm shaft 30 which is supported for such action by the central part of the housing. The shaft supports a pair of diaphragm assemblies 32 at its opposed ends, each which may comprise, as known in the art, a flexible diaphragm 34, sealed about the periphery of the respective pump chamber at 36, mounted to a rigid diaphragm plate 38.

The pump housing 12 may be preferably formed from three separately formed elements, central portion 40, and left and right end portions 42, 44 respectively, molded or otherwise developed from any appropriate material, such as a high-density plastic. The three sections may be assembled and maintained together in alignment by threaded rods 46 having nuts 48 at their ends. The central housing portion may have formed at its ends the inner sections of the pump chambers, while the end portions may include the outer sections of the pump chambers. So constructed, diaphragm seal 36 may conveniently be aligned along the mating surfaces between the central and right and left end portions.

Figure 7:
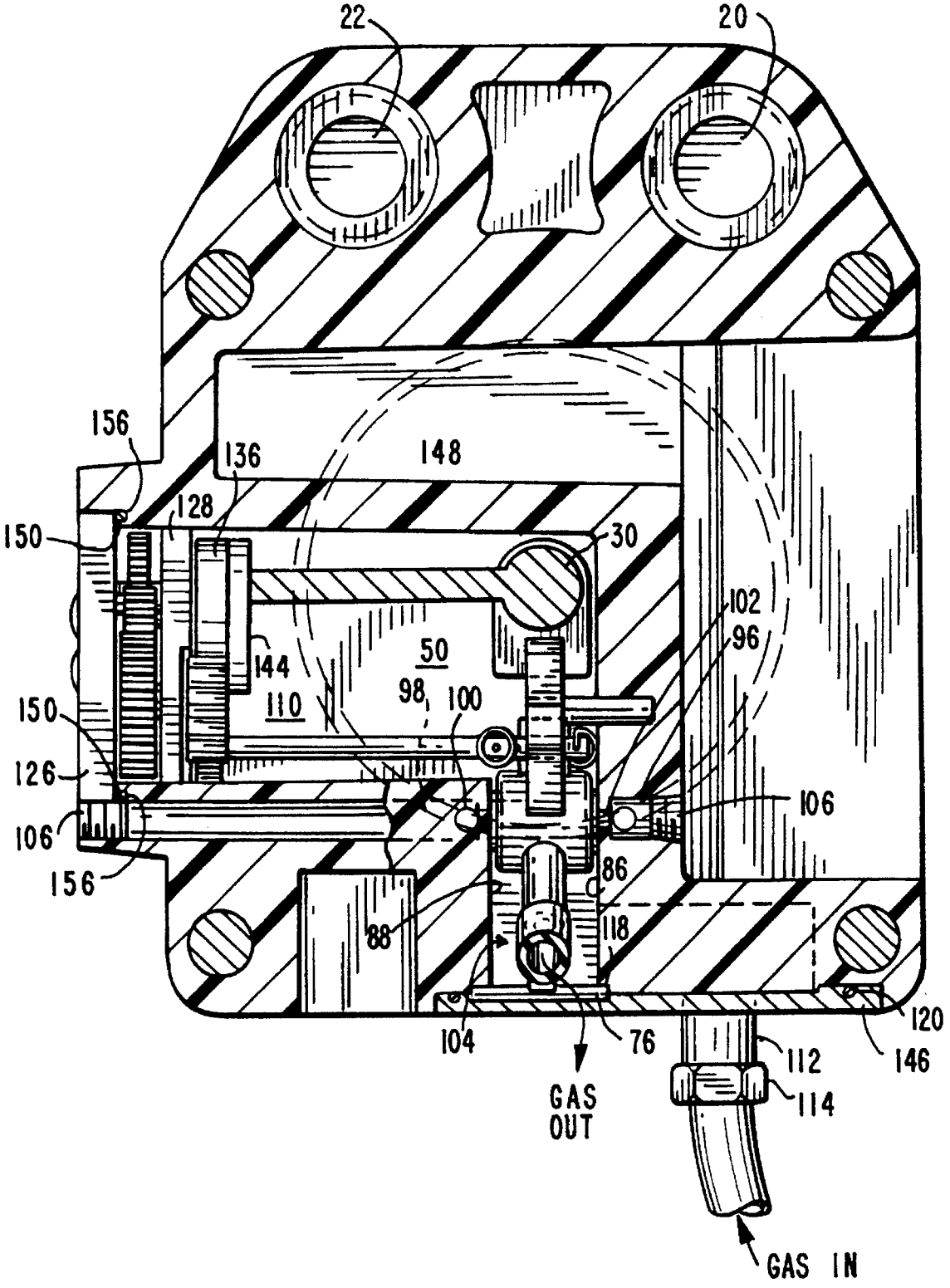
FIG. 7 is a cross-sectional view taken along line 7—7 of FIG. 4.

As seen in FIG. 4, the diaphragm assemblies 32 divide the pumping chambers into two sub-chambers, the liquid to be pumped being maintained in the outer sub-chambers. By alternatively subjecting the inner sub-chambers to a high-pressure driving gas, the diaphragm assemblies and shaft 30 may be caused to reciprocate, varying the volume of the outer sub-chambers and generating pump action. Referring generally to FIGS. 4 through 10, the central housing portion 40 is provided with a valve chamber 50 in the form of a cavity, preferably consisting of three portions. The central portion is in the form of a rectangular, vertically-oriented slot 104, as seen in FIG. 7, having parallel walls 86, 88. At the bottom of the housing the slot portion opens into a further cavity portion 108, best seen in FIGS. 2 and 4, open through the bottom of the housing which may be L-shaped in plan.

The central slot portion 104 of the cavity also joins a horizontally-extending rectangular cavity portion 110, open through a side wall of the housing, as best seen in FIG. 7. In the assembled configuration both this opening, as well as the opening formed by the L-shaped cavity, are capped with hermetic sealing members as will be subsequently explained.

The valve chamber 50 extends inwardly within the housing about the central portion of the shaft 30, which is accordingly supported by interior housing walls 52 between the chamber and the pump chambers 14, 16. Appropriate seals (not shown) may be provided between the shaft and interior walls 52.

Figure 5:
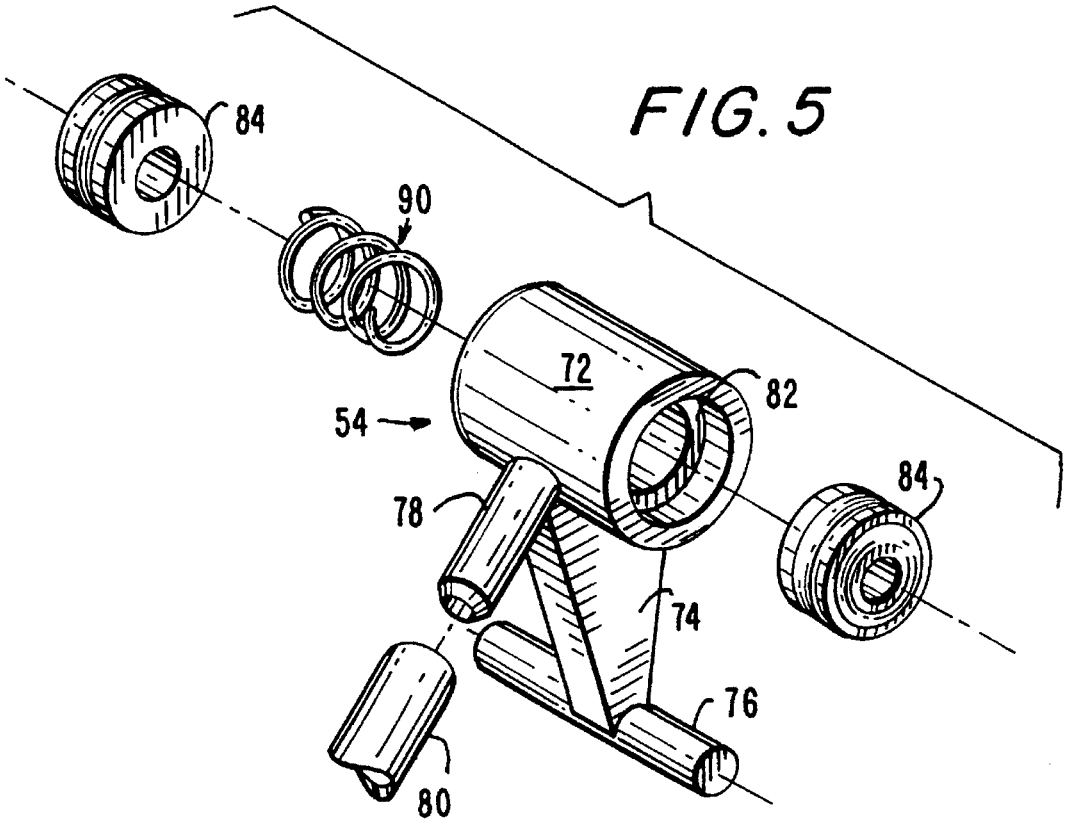
FIG. 5 is an exploded perspective view of a valve body utilized in connection with the present invention.
Figure 6:
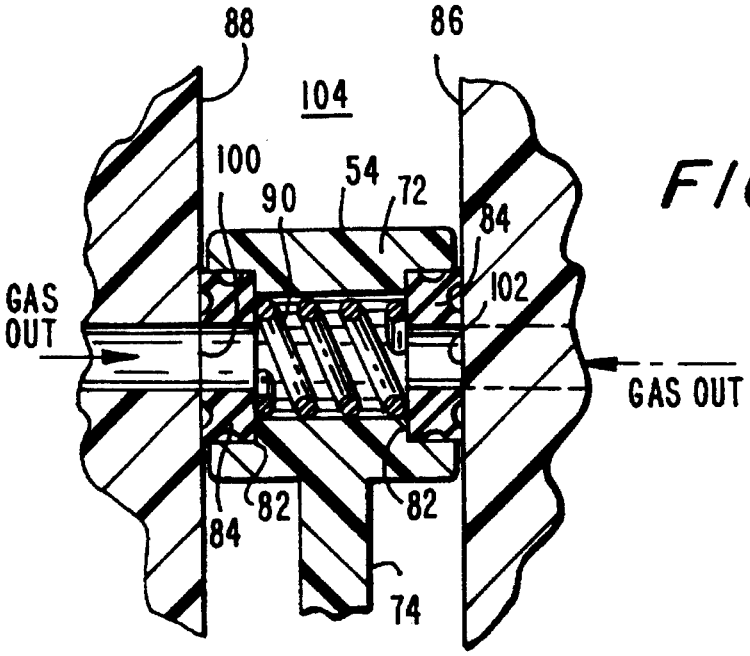
FIG. 6 is an enlarged cross-sectional view taken along line 6—6 of FIG. 4 detailing the relationship between the gas valve body and the valve chamber opposed side walls.

Valve body 54, the structure of which is detailed in FIG. 5, is supported within the central slot portion of the valve chamber for reciprocating motion synchronized with the reciprocation of the diaphragms and shaft 30. In particular, and as may be seen in FIGS. 4 and 10, the central part of the shaft 30 is provided with a pair of stops 56, which alternately engage the opposed sides of head 58 of rocker arm 60 pivotally mounted on pivot shaft 62 within the valve chamber. A pair of opposed springs 64, mounted between the rocker arm and a pair of pins 70 projecting from the valve chamber wall, drives the rocker between two alternate positions as the rocker arm pivots past its center position as a result of contact with one of the shaft stops 56. Alternatively, the two springs may be replaced by a single, U-shaped spring unit to allow the mounting pins to be eliminated. The arms 66, 68 of the rocker alternatively contact the side of the main portion of valve body 54, causing the reciprocation of the valve in response to piston action.

As detailed in FIGS. 5, 6, 8, and 9, the valve body 54 is constructed with main cylindrical portion 72 and depending arm 74, having pivot shaft 76 at its distal end. Hollow stub 78, which extends from the side wall of the main valve portion, connects with the interior of the main valve portion, and mates with vent tube 80, which leads to the exterior of the pump. The main valve portion 72 is provided with a pair of internal shoulders 82, allowing a pair of quad seal ring elements 84 to be mounted within the opposed ends of the portion. The length of the main portion 72 is chosen such that the quad seals 84 are compressed to provide a gas-tight seal between the valve element and opposed wall portions 86, 88 of the valve chamber, between which the valve body is mounted, as detailed in FIG. 6. A spring 90 is provided within the main valve body portion to maintain outward force against the quad seals, insuring that the gas-tight connection is maintained irrespective of seal wear.

The valve body 54 reciprocates between two positions in a manner whereby it allows the venting of one of the pressurizing portions of a pump chamber while simultaneously allowing for the pressurization of the other. This is accomplished by the provision of a pair of gas lines within the housing which provide a gas passageway connection between the valve chamber and the respective pressurizing portions of the pump chambers.

Figure 8:
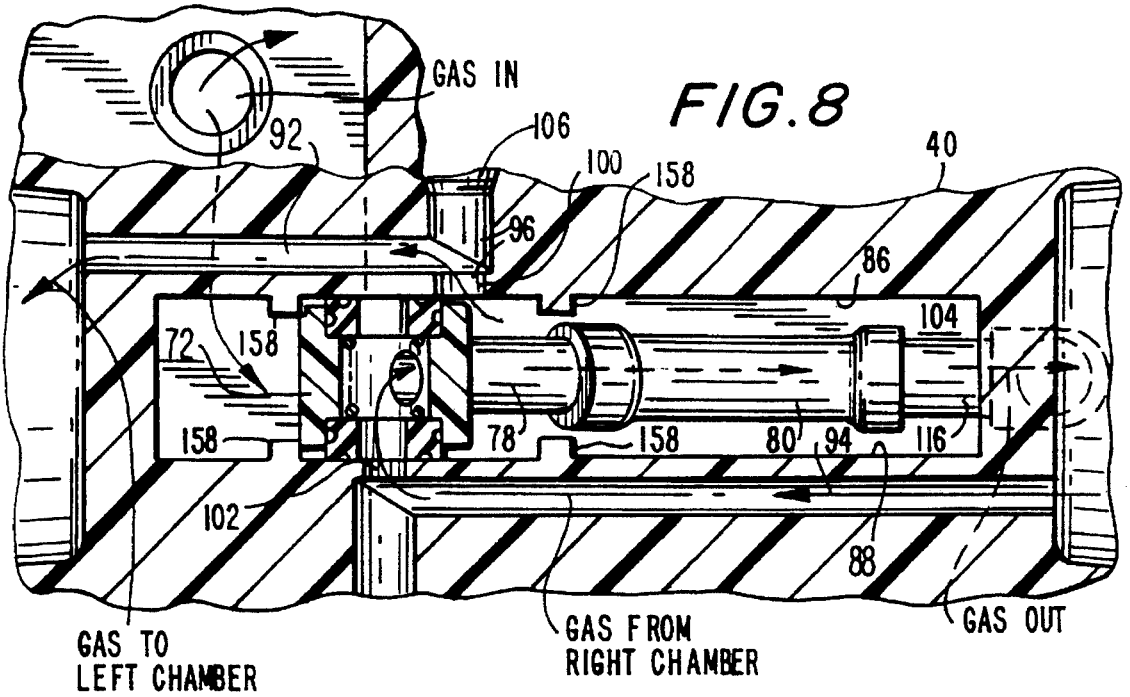
FIG. 8 is a cross-sectional view taken along line 8—8 of FIG. 4 detailing a position for the valve body whereby the right pumping chamber is exhausted and the left pumping chamber is pressurized.
Figure 9:
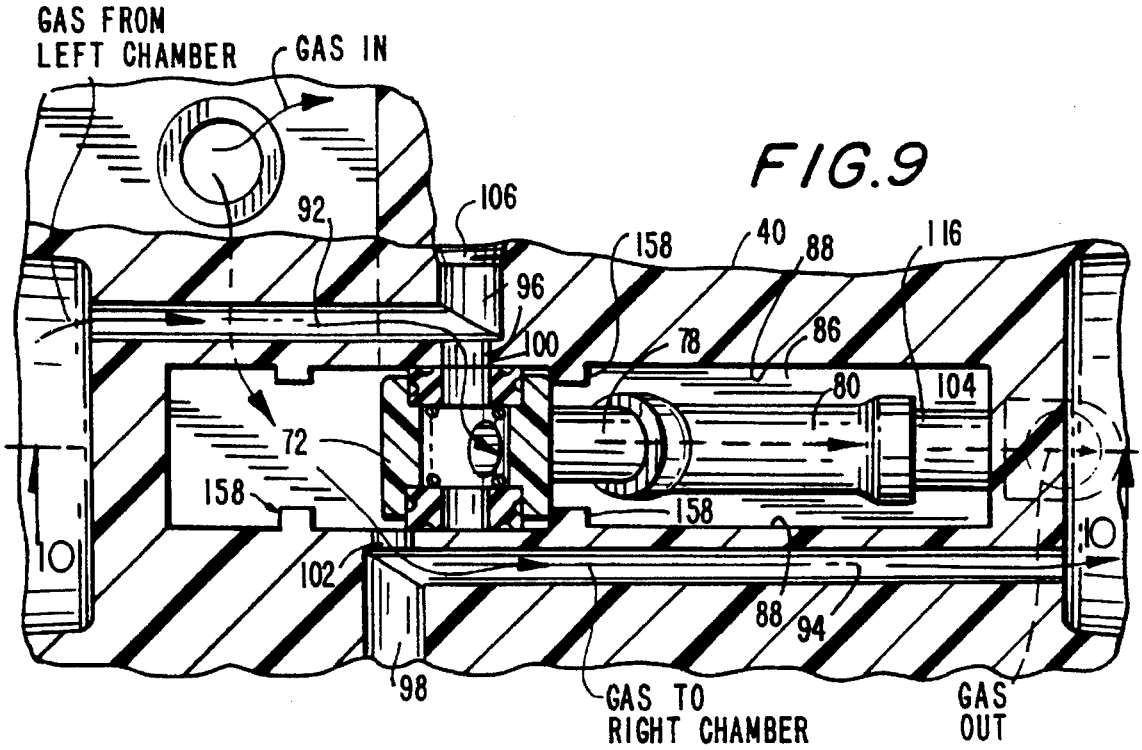
FIG. 9 is a cross-sectional view similar to FIG. 8 detailing the valve body in a position whereby the right pumping chamber is pressurized and the left pumping chamber is evacuated.

In particular, and as perhaps best seen in FIGS. 8 and 9, a pair of bores 92, 94 extend from the opposed pressurizing portions of the pump chambers laterally within the central housing portion 40. Inwardly-directed, transverse bore portions 96, 98 join with the lateral bores, and terminate in the side walls 86, 88 respectively, forming the slot portion 104 of the valve chamber. For ease of manufacture, the transverse bores 96, 98 may be drilled inwardly from the opposed exterior sides of the housing, and then sealed with plugs 106, best seen in FIG. 7, to seal the bores from the exterior.

The transverse bores 96, 98 terminate at the walls 86, 88 in ports 100, 102 which are offset from each other, as shown in FIGS. 8 and 9, whereby they alternately align with the main portion 72 of the valve body 54 at its opposed ends of travel. The valve body pivots about its pivot shaft 76 which, as may be seen in FIG. 7, may be retained in a pair of notches 118 formed in the housing at the point of intersection between the slot portion 104 and the portion 108 of the valve chamber. The limits of travel for the valve body which provide for alignment between the valve body and the ports 100 and 102 in the side wall for the bores are defined by a pair of stops 158 extending within the slot cavity portion between the side walls 86, 88, as may be seen in FIGS. 8, 9, and 10.

As seen in FIGS. 8 and 9, as the valve body reciprocates between its two end positions, the ports 100, 102 are alternatively connected to the valve body. At the same time, however, the other port is in communication with the valve chamber. As perhaps best depicted in FIGS. 7 and 10, a pipe stub 112, provided with an exterior fitting 114, extends through the central housing body to provide a gas connection between the valve chamber 50 and a source of compressed gas. Thus, while a port is exposed, the compressed gas can pass from the valve chamber through the bores into the respective pressurizing pump chamber sub-portion.

Figure 10:
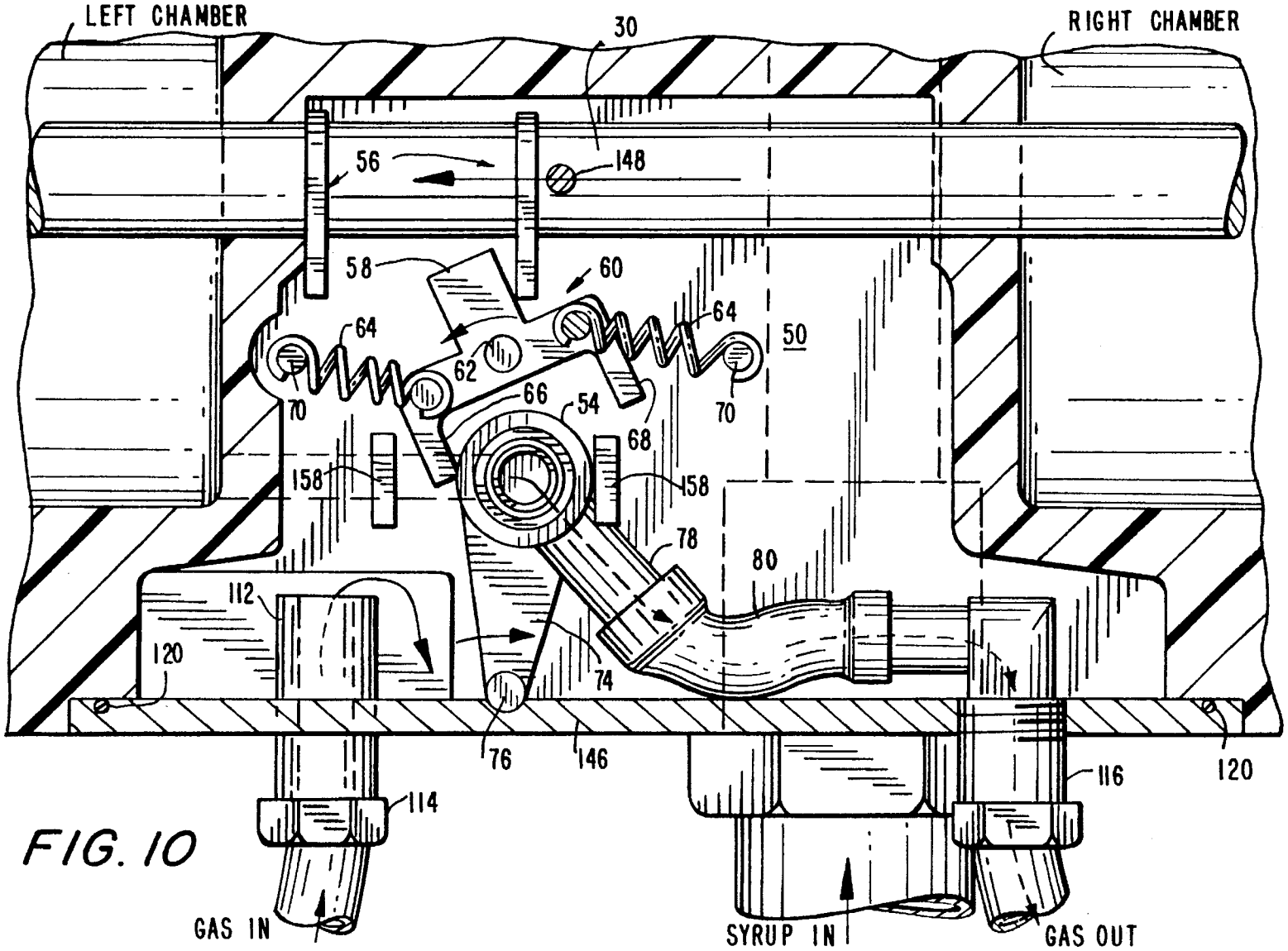
FIG. 10 is a detail cross-sectional view taken along line 10—10 of FIG. 9.

As further shown in FIGS. 8, 9 and 10, the stub 78 of the valve body 54, and its attached vent tube 80, are coupled to a stub and fitting 116 extending through the housing to vent the gas exhausting from the pump chambers to the atmosphere. Preferably both fittings 112 and 116 are mounted to a cover plate 146 which fits within a peripheral shoulder formed in the housing about the cavity portion 108 of the valve chamber. A gasket 120 is provided about the edge of the cover plate to form a gas-tight seal, the cover plate being retained by a series of bolts or other fasteners.

In order to monitor the extent of pump operation, a counter assembly 122, as depicted in FIGS. 11–14, is provided as an integral part of the pump unit. As shown therein, the counter assembly 122 may be formed with a gear train 124 being mounted between front and rear plates 126, 128, respectively. As known in the art, the individual gear elements are formed and interconnected in a decade series, that is, each of the main gears 130 rotates at one-tenth the speed of the previous main gear. In order to form an assembly of minimal thickness the individual gears are arranged in a planar relation, each gear being mounted upon a separate gearshaft.

The shaft of the first gear of the gear train is provided with ten tooth star wheel 134, preferably mounted upon an extension of the gear's shaft extending outwardly from the rear plate 128. Pawl 136 is pivotally mounted upon pin 138 on rear plate 128, and includes a pair of alternately star wheel-engaging teeth 140 at its first end. The pawl terminates at its second end with a pin 142. Overlying the pawl is counter arm 144, which is pivotally mounted on pin 164 projecting from the rear plate 128. The counter arm includes arcuate portion 166, having arcuate slot 168. Pawl pin 142 is restrained within the slot. The upper end of the counter arm is provided with a recess 170, into which the pin 148 which projects from the diaphragm shaft 30 extends.

As the diaphragm shaft reciprocates, pin 148 causes the synchronous reciprocation of counter arm 144 about pin 164. The arcuate nature of slot 168 results in a vertical reciprocating motion being applied to pin 142, which causes counter pawl 136 to pivot about pin 138, its star wheel-engaging teeth 140 driving star wheel 134 one tenth of a turn with each full reciprocation. The star wheel is connected to the first main gear through a geneva assembly (not shown), such that the gear similarly rotates one tenth of a turn with each diaphragm shaft reciprocation.

The front plate 126 is of greater area than the rear plate 128, allowing it to serve as a means of mounting for the counter within the cavity portion 110 of the valve chamber. A peripheral gasket 156 rests between the periphery of the front plate and a shoulder 150 of the cavity portion 110 to provide a hermetic Seal. Fasteners 152 hold the assembly in place.

Because the front plate 126 also serves as a cover for the valve chamber, the shafts for the gear train may be advantageously molded as projections for the inner face of the plate to avoid the need for supporting bores in the plate. Two or more of the projections, such as projection 154, extend through a bore in the rear plate 128 to align the plates. A C clip 160 engages a peripheral groove in the projection to retain the counter in the assembled state.

Figure 11:
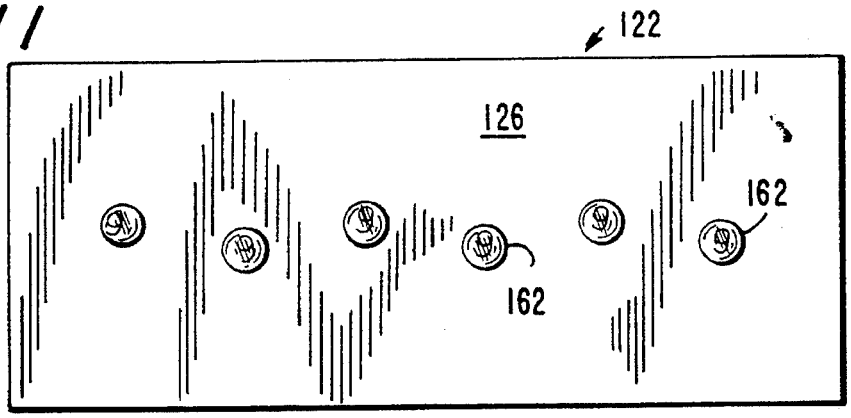
FIG. 11 is view of the face of the counter assembly of the present invention.
Figure 12:
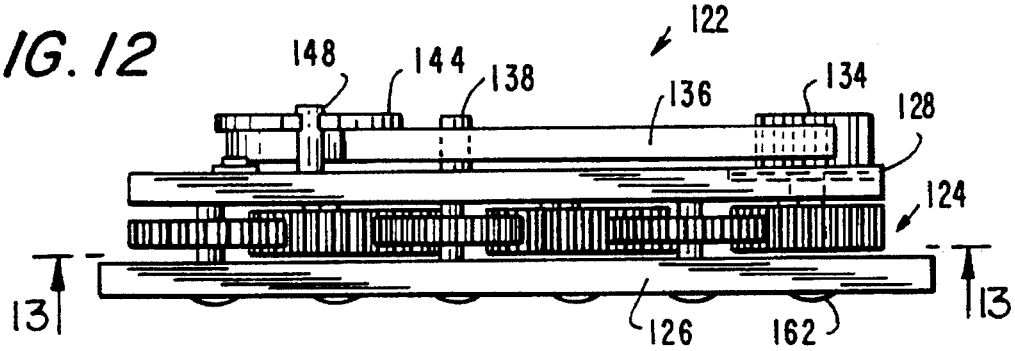
FIG. 12 is a top plan view thereof.
Figure 13:
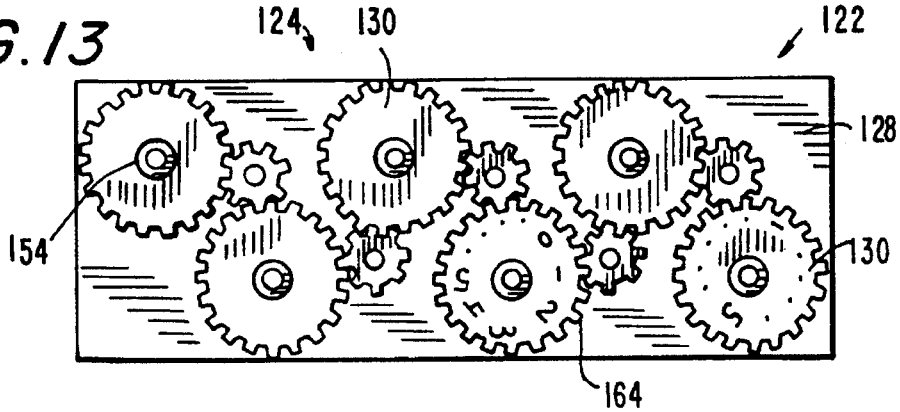
FIG. 13 is a cross-sectional view of the counter assembly taken along line 13—13 of FIG. 12.
Figure 14:
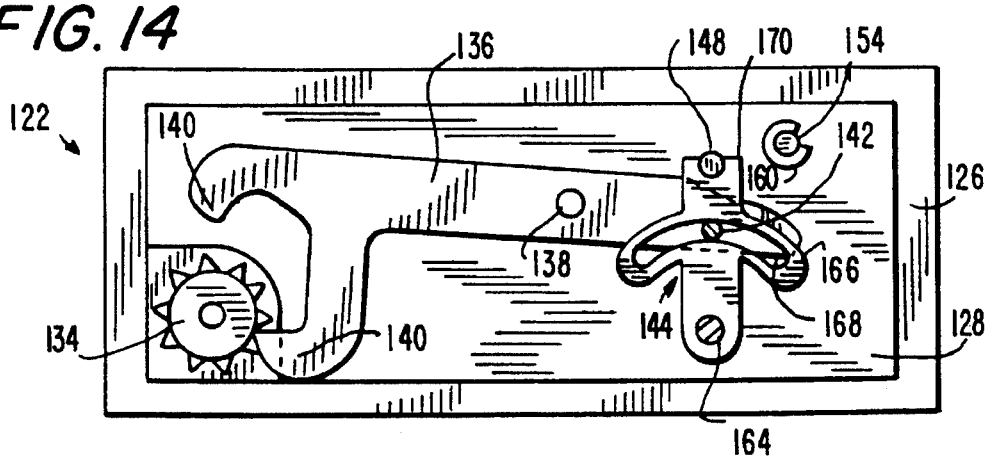
FIG. 14 is a rear view of the counter assembly detailing the assembly which drives the counter.

The front plate may be further provided with integral lens portions 162, shown in FIGS. 11 and 12 which are located to align and magnify a portion of each of the front surfaces of the main gears 130 as they pass beneath the lens. Numbers 164 are provided on the front surfaces, whereby the lenses allow a numerical indication of gear rotation, and thus pump cycles to be observed.

The construction of the present invention provides a pump with a minimum number of operating parts, and which includes an integral counter assembly which further enhances operation of the pump unit, as it provides a visual indicator of cumulative pump operation. Such an indicator system allows maintenance to be scheduled in a meaningful manner, based upon pump operation.

It is to be recognized that modifications and adaptations to the invention as specifically disclosed herein may be accomplished without departing from the scope of the invention. Accordingly, such scope is to be measured with reference to the claims which define the metes and bounds of the invention.

We claim:

1. A pneumatically-operated pump, comprising:

a housing;

a pair of opposed pump chambers in said housing, each of said pump chambers having a reciprocating diaphragm dividing the pump chamber into a variable volume pumped-fluid receiving chamber and a variable volume pressurization chamber;

a shaft connecting said diaphragms;

valve means in said housing, comprising a valve chamber and a valve body mounted within the valve chamber, said valve means coupled to said pressurization chambers for alternately pressurizing and venting said pressurization chambers to effect diaphragm and shaft reciprocation;

and a counter mounted within said valve chamber coupled to said shaft for counting the reciprocations thereof.

2. The pump of claim 1, wherein said valve chamber is in the form of a cavity opening through a side of said housing, said counter having a front face dimensioned to be mounted about said cavity opening to seal said cavity opening.

3. The pump of claim 2, wherein said counter is mechanically coupled to said shaft through an escapement.

4. The pump of claim 3, wherein said counter comprises a decade gear assembly having a plurality of main gears arranged in a linear manner, each of said main gears having counting indicia on an outwardly-directed face thereof, said counter front face having means for selectively displaying a portion of each of said outwardly-directed gear faces whereby the total rotation of said gears can be observed and determined .

5. The pump of claim 4, wherein said display means comprise a series of transparent lens portions formed in said front face.

* * * * *